United States Patent [19]

Giolli

[11] Patent Number: 5,047,599

[45] Date of Patent: Sep. 10, 1991

[54] LOCKING HOUSING FOR A SWITCH

[76] Inventor: Donald A. Giolli, 538 W. Westmere Rd., Des Plains, Ill. 60016

[21] Appl. No.: 498,267

[22] Filed: Mar. 23, 1990

[51] Int. Cl.[5] ..... H01H 9/28

[52] U.S. Cl. ..... 200/43.022; 200/43.01; 220/3; 220/241; 220/3.8; 206/223; 70/164; 70/DIG. 30; 70/DIG. 56; 174/67

[58] Field of Search ..... 200/43.01, 43.19, 43.22; 220/3.8, 241, 242; 206/223; 174/67; 70/162, 164, DIG. 30, DIG. 34, DIG. 56

[56] References Cited

U.S. PATENT DOCUMENTS

| | | | |
|---|---|---|---|
| 2,458,002 | 1/1949 | Kaskouras . | |
| 2,987,909 | 6/1961 | Shlank | 174/67 X |
| 3,444,712 | 5/1969 | Greenwald . | |
| 3,467,763 | 9/1969 | Shaw | 174/67 |
| 3,660,996 | 5/1972 | Syvertson . | |
| 4,126,023 | 11/1978 | Smith et al. . | |
| 4,127,967 | 12/1978 | Franzl . | |
| 4,469,238 | 9/1984 | Ranalli | 220/242 X |
| 4,570,467 | 2/1986 | Greco . | |
| 4,638,129 | 1/1987 | Partus et al. | 200/43.22 |
| 4,663,950 | 5/1987 | Mascotte . | |
| 4,895,999 | 1/1990 | Calderon | 174/67 |

FOREIGN PATENT DOCUMENTS

| | | | |
|---|---|---|---|
| 2226911 | 11/1974 | France | 200/43.22 |

OTHER PUBLICATIONS

"Q Mark Electric Heating Products", Jun. 1989, pp. 25–26, catalog of Markey Heating Products.

"Danfoss RA 2000", Sep. 1988, Product brochure.

*Primary Examiner*—Ernest G. Cusick

*Attorney, Agent, or Firm*—Lockwood, Alex, FitzGibbon & Cummings

[57] ABSTRACT

A locking closure for a rotary control member includes a compartment portion, a base portion and an access portion. The access portion has an access opening disposed therein proximate to and adjacent to the rotary control member. A cover plate is securely mounted on the closure access portion and covers the access opening. The access portion includes an extension which interferingly engages an edge of the cover plate so as to prevent any rotational movement of the cover plate away from the access opening.

19 Claims, 1 Drawing Sheet

LOCKING HOUSING FOR A SWITCH

BACKGROUND AND SUMMARY OF THE INVENTION

The present invention relates generally to locking closures or devices and, more particularly, to a locking closure mounted over a rotary switch shaft to prevent access to the rotary switch by an unauthorized user. In this regard, one important aspect of the present invention is directed to a locking device assembly for a rotary switch shaft which is especially suited for mounting over electric heater thermostatic switches and the like, which assembly includes a casing enclosing the switch shaft and having an opening positioned in alignment with the rotary switch shaft, which opening is covered by a cover plate secured to the casing face.

Rotary switches are used in a variety of different applications. Most commonly, rotary switches are used as thermostatic controls on electric radiators, heaters and the like as well as speed controls on ceiling fans and blower motors. Typically, these rotary switches comprise an external dial or knob which is mounted on an elongated shaft leading to the actual switch mechanism located inside the casing of the particular piece of equipment which it controls.

When used on ceiling fans or electric radiators, it is desirable to either set the ceiling fan at a specific speed or set the electric heater at a specific desired temperature. In order to maintain the fan speed or heater temperature at the desired fixed setting, the rotary control switch must be immobilized at the chosen setting. Maintainance of the switch setting is beneficial from an energy conservation viewpoint. Permanently fixing the rotary switch dial at the setting is not a viable solution because it prevents subsequent resetting of the equipment to adjust to particular environmental conditions. Removal of the switch dial does not serve as an effective solution either, because the switch shaft can still be turned by the use of a pair of pliers or other similar tool. It is desirable to fix the switch setting, but allow the switch to be reset by an authorized person when the need arises. Accordingly, a need exists for a device which encloses a rotary switch shaft which prevents access to and adjustment of the rotary switch by an unauthorized person but allows an authorized person access to the switch to allow the adjustment and/or operation thereof.

The locking closure assembly of the present invention prevents access to the switch shaft by an unauthorized person, yet allows an authorized person access to the switch. In a locking closure assembly incorporating the principles of the present invention, a closure casing which encloses the rotary switch shaft is mounted on a surface surrounding the shaft so that an opening extending through one face of the casing is aligned with the switch shaft. A cover plate covers the opening and is secured to the casing face by security means. One or more extensions of the closure casing engage the cover plate in a manner to securely retain the cover plate in place on the casing over the opening.

Accordingly, it is a general object of the present invention to provide a locking closure assembly for enclosing a switch shaft or control member and preventing access to the switch by an unauthorized person.

Another object of the present invention is to provide a locking closure assembly for enclosing and preventing access to a control member in which an outer casing encloses the switch shaft or control member and has an access opening disposed in a face of the outer casing in alignment with the control member, the access opening being covered by a cover plate secured over the opening.

A further object of the present invention is to provide a locking closure assembly for a longitudinal control member having an outer casing which encloses the control member and attaches to a surface proximate to the control member, an opening disposed in an exterior wall of the casing in general alignment with and which allows limited access to the control member, a separate cover means which covers the opening, the cover means being secured to the casing exterior wall by a security screw, and means for securing the cover means in place upon the casing exterior wall and preventing the movement thereof.

A yet further object of the present invention is to provide a locking device for an electric radiator thermostatic control switch having a casing adapted to be attached to the radiator, the casing having a plurality of exterior walls which define a control switch shaft, one exterior wall having an opening therein disposed in proximity to and alignment with the control switch shaft, the opening being covered with a plate secured to the casing exterior wall by a security lock, the plate being restricted from lateral movement away from the opening by extensions of the casing exterior walls.

These and other objects, features and advantages of the present invention will be apparent from the following detailed description, taken in conjunction with the accompanying drawings wherein like reference numerals refer to like parts.

BRIEF DESCRIPTION OF THE DRAWINGS

In the course of this detailed description, reference will be made to the attached drawings in which.

DETAILED DESCRIPTION OF THE INVENTION

Figures 1, 2, 3, 4:
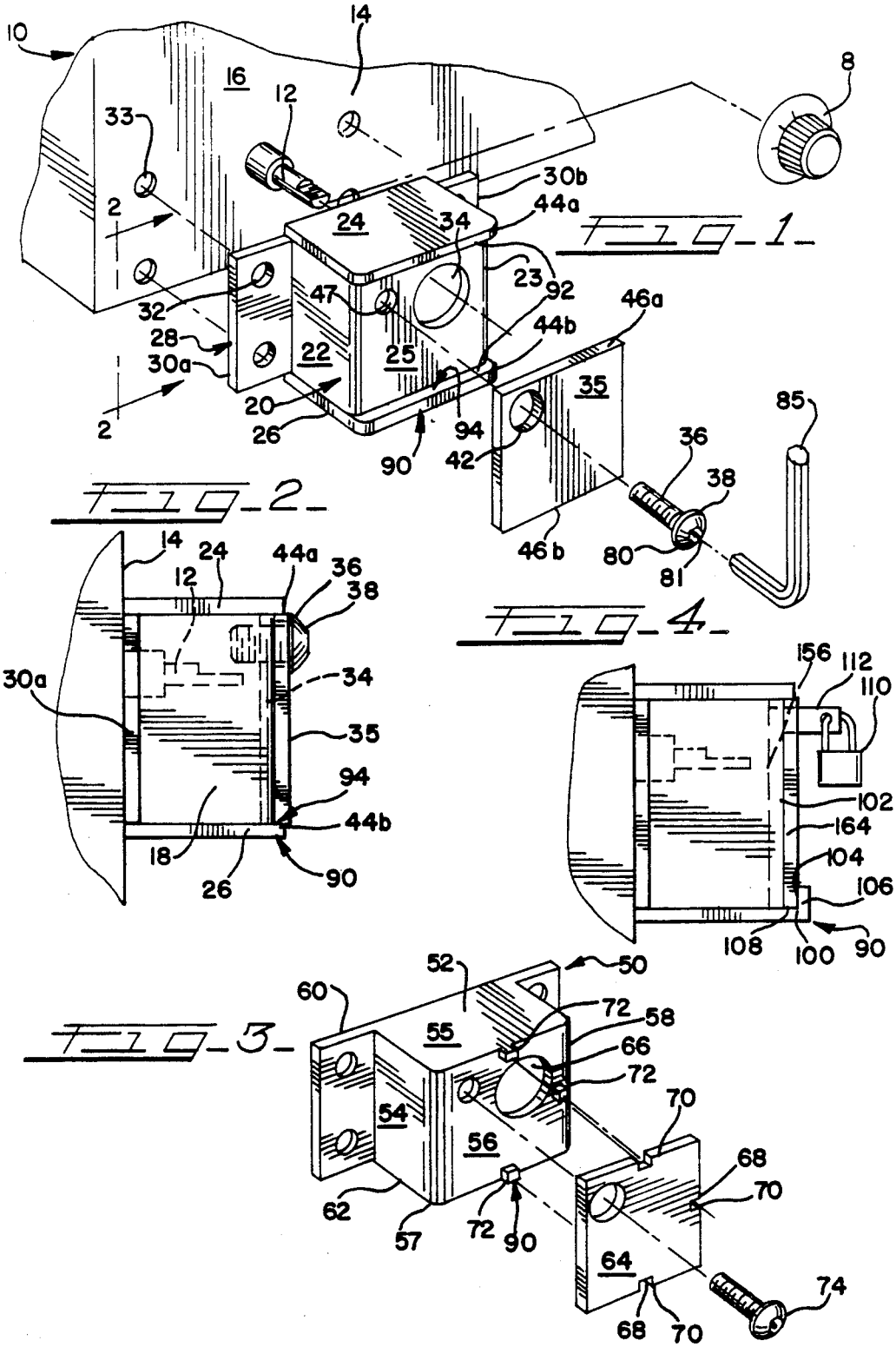
FIG. 1 is an exploded perspective view of a locking closure assembly constructed in accordance with the principles of the present invention.
FIG. 2 is a sectional view of the locking closure assembly of FIG. 1 taken along lines 2—2.
FIG. 3 is an exploded perspective view of another embodiment of a locking closure assembly constructed in accordance with the principles of the present invention having an integral enclosure casing.
FIG. 4 is a sectional view of a locking closure assembly showing an alternate cover plate retaining means.

Referring now to FIG. 2, a locking closure 10 constructed in accordance with the principles of the present invention is shown disposed in alignment with a rotary switch shaft or control member 12 proximate to the exterior surface 14 of the housing 16 for a piece of equipment which the shaft 12 controls.

As can best be seen from FIGS. 1 and 2, the locking closure 10 includes an interior compartment 18 of the closure casing 20 which is defined by a plurality of closure exterior walls, 22 through 26. A closure casing base portion 28 is provided in the form of two oppositely extending tabs **30*a*, 30*b* which are dimensioned and adapted to engage the exterior surface 14 of the equipment housing 16**.

After the control dial 8 of the piece or equipment has been removed, the base tabs **30*a*, 30*b* are secured to the equipment housing 16 by any conventional means such as screws, pop rivets or spot welding by way of the tab holes 32 which are mated with like holes 33 in the equipment housing 16. In the embodiment shown in FIGS. 1 and 2, the casing 20 is preferably formed from a metal and bent so as to form the base tabs 30A, 30B, the two sidewalls 22, 23 and the front sidewall 25 from a single piece of metal. To complete the interior switch compartment 18, the top and bottom walls 24 and 26, respectively, may be welded to a separate generally U-shaped piece which contains the two sidewalls 22, 23 and the front wall 25. It will be appreciated that apart from a metal, any high strength and impact resistant plastic material may be used to form the closure casing 20**.

A switch access opening 34 is provided in the front wall 25 of the closure casing 20 and is disposed in general alignment with and closely adjacent to the rotary switch shaft 12. The diameter of the access opening 34 is preferably sufficiently small to prevent the rotary switch shaft 12 from being gripped by a person's fingers. Thus, when the closure casing 20 is in place on the equipment housing 16, the rotary switch shaft 12 can only be turned and set by a person using an elongated tool or pliers.

The access opening 34 is sealed off to an unauthorized person by effective protective cover means comprising a cover plate 35 which is disposed over the access opening 34 in an abutting relationship to the front wall 25 of the closure casing 20. The cover plate 35 is secured to the closure casing 20 by security means, shown as a security screw 36, (i.e., one that has a specially configured head 38 with an opening 80 and having a stem 81 centrally disposed therein which can only be operated by a specially configured tool 85) which passes through a screw opening 42 in the cover plate 35 and threadedly and releasably engages a hole 47 in the casing front sidewall 25.

In an important aspect or the present invention, the the closure casing 20 is provided with means for retaining the cover plate 35 in place on the front wall 25 over the access opening 34 which interferes with and prevents any movement of the cover plate 35 relative to the casing front sidewall 25 away from the access opening 34. This retaining means prevents the cover plate 35, after installation on the closure casing 20, from being pushed or urged aside from the access opening 34 so as to expose the access opening 34 and the rotary switch shaft 12 in the interior compartment 18 of the closure casing 20. The retaining means preferably takes the form or an extension 90 of the closure casing 20 which engages at least one distinct surface 94 of the cover plate 35. In the embodiment shown in FIGS. 1 and 2, the retaining means are illustrated as two elongated ledges **44*a*, 44*b* which extend out from the closure casing top and bottom walls 24, 26, respectively along the peripheral edges 92 of the front wall 25** and in a generally parallel relationship to each other.

The ledges **44*a*, 44*b* engage two distinct opposing surfaces 46*a*, 46*b* of the cover plate 35. The retaining means extension 90 must engage a distinct surface of the cover plate 35 in a manner so that the rotation of the cover plate 35 on the front wall 25 surface is prevented. Where one extension 90 is used, it is preferred that the extension 90 extends along substantially the entire length of one of the peripheral edges 92 or the front wall 25. Where two separate extensions are used, they can either extend the full length of the two peripheral edges 92 as illustrated best in FIG. 2, or they can extend less than the full length, provided they are of a length sufficient to hold the cover plate 35 in place and prevent it from being rotated in place on the closure casing 20**.

Alternatively, as is shown in another embodiment 50 of the present invention illustrated in FIG. 3, the closing 20 and its associated interior compartment 18 may be either integrally formed from a metal casting 52 or molded from a durable, high strength and impact resistant plastic or other suitable compound in which the casing sidewalls 54 through 58 and the casing base 60 are integrally formed as a one-piece component 62. Similar to the embodiment shown in FIG. 1 and 2, the cover plate 64 of the FIG. 3 embodiment is dimensioned to cover the access opening 66. However, the cover plate retaining means includes at least one extension or lug 72 of the casing front wall 56 which is received in a series of notches 68 cut in the edges 70 of the closure cover plate 64. Although three pairs of such extensions and notches are illustrated in FIG. 3, it will be understood that the use of one or two extensions 72 will accomplish the same desired result of preventing the cover plate 64 from being rotated upon the casing front sidewall 56 after the security screw 74 is tightened.

Moreover, the retaining means can also include one or more channel members 100 which extend from the casing front wall 102. As shown in the embodiment illustrated in FIG. 4, the channel member 100 includes a cover plate groove 104 and a projecting lip 106 which slidingly receives one edge of the cover plate 108. Also, the security means which secures the cover plate 164 is shown as a locking member 110 which engages a stud 112 extending from the casing front wall 156.

The installation of the present invention is simple. Once the rotary switch dial 8 is removed from the equipment housing 16, the closure casing 20 is aligned over the switch shaft 12 so that the switch shaft 12 is in alignment with the switch access opening 34. The housing holes 33 can then be drilled into the housing 16 and the closure casing 20 mounted thereon. The cover plate 35 is then positioned over the switch access opening 34 in engagement with the retaining means extension(s) **44*a*, 44*b* and the security screw 36 is then tightened with a security wrench 85**.

From the foregoing, a unique locking closure as been described and illustrated. The locking closure can be used on a variety of equipment to prevent access to and tampering with the equipment control member. The locking closure can be used on an apartment building hallway electric heater to secure and maintain the thermostatic setting of the heater so that the hallway temperature is kept constant. Similarly, it can be used on an electrically powered ceiling fan speed control switch member to maintain the speed of the ceiling fan at a constant. In both such applications, the energy savings achieved by the user will be readily apparent. Moreover, the locking closure enables an authorized person to readily gain access to the switch shaft to allow the equipment setting to be easily reset.

Finally, it will be understood that the above description of the present invention is merely illustrative of a few applications of the principles of the invention. Numerous modifications may be made by those skilled in the art without departing from the true spirit and scope of the invention.

I claim:

1. A locking closure for a rotary switch member comprising:

a closure casing adapted to receive and cover the rotary switch member, the casing having a plurality of exterior walls which define a compartment which encloses said rotary switch member, said casing also having a base portion adapted to mount said casing on a surface proximate to said rotary switch member, said casing further having a switch member access opening disposed in a casing exterior wall in alignment with and proximate to said rotary switch member, the switch member access opening providing limited access to said rotary switch member;

means for covering said switch member access opening in the form of a cover plate, the cover plate being disposed over said switch member access opening and preventing access to said rotary switch member;

means for securing said cover plate to said casing in a secure position over said opening, said securing means releasably engaging a portion of said casing; and means retaining said cover plate on said casing exterior wall in a covering position over said opening, the retaining means including at least one extension of said casing which interferingly engages said cover plate and prevents the movement thereof relative to said casing exterior wall.

2. The locking closure of claim 1, wherein said cover plate retaining means includes two generally parallel ledge members extending outwardly from said casing.

3. The locking closure of claim 1, wherein said cover plate retaining means at least one extension is disposed along substantially the entire length of an edge of a first wall of said plurality of casing exterior walls and further protrudes outwardly from said first casing exterior wall.

4. The locking closure of claim 1, wherein said securing means includes a security screw threadedly releasably engaging a first wall of said plurality of casing exterior walls.

5. The locking closure of claim 4, wherein said closure casing is a metal casting and said cover plate retaining means includes two extensions which integrally extend from said first casing exterior wall and are disposed generally perpendicular to each other, said cover plate further including at least two notches which engage and receive said two extensions.

6. The locking closure of claim 1, wherein said casing at least one extension is a channel member, the channel member having an elongated groove therein which receives and engages a distinct surface of said cover plate.

7. The locking closure of claim 1, wherein said securing means includes a locking member releasably engaging a portion of a first wall of said plurality of casing exterior walls.

8. A tamperproof locking device for a rotary control member comprising:

a casing adapted to receive the rotary control member in an enclosure portion, the casing enclosure portion being defined by a plurality of exterior walls of the casing, said casing having a base portion proximate to said casing enclosure portion, the casing base portion being adapted to be mounted on a mounting surface surrounding said rotary control member, said base portion including means for attaching said casing base portion to the mounting surface, said casing having a rotary control member access opening disposed in a first exterior wall of said casing enclosure portion, the rotary control member access opening being in alignment with and generally adjacent to said rotary control member when said casing base portion is mounted on said mounting surface, said rotary control member access opening providing limited access to said rotary control member, means for covering said rotary control member access opening and preventing access to said rotary control member including a cover, the cover being removably secured to the casing first exterior wall of said casing by security means, said casing further including stop means for preventing any substantial movement of said cover upon said casing first exterior wall and away from said rotary control member access opening, the stop means engaging at least a portion of an edge of said cover.

9. The tamperproof locking device of claim 8, wherein said stop means includes two generally parallel ledge members extending outwardly from said casing.

10. The tamperproof locking device of claim 8, wherein said casing is a metal casting and said casing enclosure portion is integrally formed with said casing base portion, said stop means including an integral extension of said casing enclosure portion.

11. The tamperproof locking device of claim 8, wherein said stop means includes at least one channel member extending from said casing enclosure portion, the least one channel member slidingly receiving a portion of said cover therein.

12. The tamperproof locking device of claim 8, wherein said stop means includes two ledge members extending outwardly from said casing, the two ledge members being angularly offset on said casing with respect to each other.

13. The tamperproof locking device of claim 8, wherein said security means includes a security screw threadedly engaging said casing first exterior wall.

14. The tamperproof locking device of claim 8, wherein said security means includes a locking member which releasably engages a portion of said casing first exterior wall.

15. A kit of parts for converting a rotary control member projecting through a surrounding surface into a tamperproof housed rotary control member, the kit of parts comprising:

a housing adapted to enclose the rotary control member, the housing having a housing compartment portion, a housing base portion and a housing access portion, the housing base portion being adapted to engage the surrounding surface of said rotary control member, the housing compartment portion being adapted to receive the rotary control member, the housing access portion having an access opening in general alignment with and generally adjacent to said rotary control member, the access opening providing limited access to said rotary control member;

said housing access portion further including a separate, housing cover portion adapted to cover said housing access opening and prevent access to said rotary control member, the housing cover portion being secured to said access portion by security means including a security screw threadedly engaging said housing access portion, said security screw being adapted to receivingly engage a security key for tightening and loosening of said security screw; and a first security key adapted to engage said security screw;

means for retaining said housing cover portion in place on said housing access portion so as to substantially prevent any relative rotational movement between said housing cover portion and said housing access portion, said retaining means including an extension of said housing extending outwardly from said housing and proximate to said housing access portion, said retaining means interferingly engaging said housing cover portion to prevent the movement of said housing cover portion on said housing access portion away from said access opening.

16. The kit of parts of claim 13, wherein said housing compartment portion is generally rectangular and said retaining means includes two parallel ledge members.

17. The kit of parts of claim 13, wherein said housing compartment portion, base portion and access portion are integrally formed as a one-piece housing assembly, said at least one extension of said housing access portion also being integrally formed with said one-piece housing assembly, said at least one housing access portion extension being integrally received in a notch in said housing cover portion.

18. The kit of parts of claim 13, wherein said retaining means includes at least one elongated channel member having a cover portion groove therein which slidingly receives an edge of said cover portion.

19. A locking closure for an electric heater temperature control switch comprising: a generally flat base portion, means for securing the base portion to the electric heater, the base portion including a housing portion extending therefrom into which the electric heater temperature control switch extends, the housing having an opening generally aligned with and generally adjacent to said electric heater temperature control switch, a cover disposed generally adjacent to said housing and over the housing opening, security means mounting said cover on said housing portion and enclosing said electric heater temperature control switch in said housing portion and cover engagement means in the form of at least one extension of said housing, the at least one extension of said housing portion engaging said cover and preventing movement of said cover away from said housing portion opening.

* * * * *